US008082734B2

(12) United States Patent
St. Denis

(10) Patent No.: US 8,082,734 B2
(45) Date of Patent: Dec. 27, 2011

(54) DRIVE ASSEMBLY FOR A RECIPROCATING PUMP UTILIZING A LINEAR ACTUATOR

(75) Inventor: Perry L. St. Denis, Lloydminster (CA)

(73) Assignee: 1238585 Alberta Ltd., Lloydminster (CA)

( * ) Notice: Subject to any disclaimer, the term of this patent is extended or adjusted under 35 U.S.C. 154(b) by 749 days.

(21) Appl. No.: 11/997,140

(22) PCT Filed: Jun. 5, 2006

(86) PCT No.: PCT/CA2006/000934

§ 371 (c)(1),
(2), (4) Date: Aug. 6, 2008

(87) PCT Pub. No.: WO2007/012172

PCT Pub. Date: Feb. 1, 2007

(65) Prior Publication Data

US 2008/0302096 A1 Dec. 11, 2008

(30) Foreign Application Priority Data

Jul. 28, 2005 (CA) ..... 2514916

(51) Int. Cl.
*F16D 31/02* (2006.01)

(52) U.S. Cl. ..... 60/369

(58) Field of Classification Search ..... 60/369
See application file for complete search history.

(56) References Cited

U.S. PATENT DOCUMENTS

| | | | |
|---|---|---|---|
| 3,777,491 | A | 12/1973 | Bender |
| 3,782,117 | A | 1/1974 | James |
| 4,170,340 | A | 10/1979 | Mouton, Jr. |
| 4,187,680 | A | 2/1980 | Sanford |
| 4,341,270 | A | 7/1982 | Ferguson |
| 4,341,373 | A | 7/1982 | Mouton, Jr. |
| 4,400,141 | A | 8/1983 | Lee et al. |
| 4,418,609 | A | 12/1983 | Wickline |
| 4,512,149 | A | 4/1985 | Weaver |
| 4,696,221 | A | 9/1987 | Dollison |
| 6,032,929 | A | 3/2000 | Vatne |
| 6,095,501 | A | 8/2000 | Vatne |

FOREIGN PATENT DOCUMENTS

| | | |
|---|---|---|
| CA | 2451907 A1 | 6/2005 |
| RU | 2133875 C1 | 7/1999 |

*Primary Examiner* — Michael Leslie
(74) *Attorney, Agent, or Firm* — Christensen O'Connor Johnson Kindness PLLC

(57) ABSTRACT

A drive assembly for a reciprocating pump includes a support structure with a linear actuator mounted on the support structure. The linear actuator has a stationary portion and a movable ram portion. At least one direction altering cable guide is mounted to the movable ram portion of the linear actuator. At least one cable is provided having a first end and a second end. The first end is anchored to one of the support structure or the stationary portion of the linear actuator. The second end is adapted for attachment to a polish rod of a reciprocating pump. As the movable ram portion moves, the cable and cable guide configuration provide a mechanical advantage which results in the polish rod reciprocally moving a multiple of the distance travelled by the movable ram portion of the linear actuator.

2 Claims, 7 Drawing Sheets

DRIVE ASSEMBLY FOR A RECIPROCATING PUMP UTILIZING A LINEAR ACTUATOR

FIELD OF THE INVENTION

The present invention relates to a drive assembly for a reciprocating pump and, in particular, a drive assembly that uses a linear actuator.

BACKGROUND OF THE INVENTION

Reciprocating pumps are extensively used on oil wells. They generally consist of a polish rod with cooperating valves, that serve to pump liquids to surface as the polish rod is raised and lowered in the well. There are various types of drives used to raise and lower the polish rod. Examples of linear actuators include hydraulic rams and lifting screws.

A problem common to linear actuators, such as hydraulic rams and lifting screws, is that the longer they extend, the more they are prone to deflection. This deflection can lead to jamming, bending, or fatigue failure. Persons skilled in the art presently avoid deflection problems by increasing the diameter of the linear actuator or limiting the length of the reciprocating stroke of the linear actuator.

U.S. Pat. No. 3,777,491 (Bender) and U.S. Pat. No. 4,512,149 (Weaver) disclose telescopic fluid cylinders with movable ram portions which carry cable guides. The combination of cables with the telescopic fluid cylinders unit results in the polish rod being lifted a distance which is a multiple of the distance of travel of the movable ram.

SUMMARY OF THE INVENTION

There is provided a pumping unit in which a rotating screw with a travelling nut are combined with a pair of telescopic fluid cylinders. The rotating screw and travelling nut serve as a primary linear actuator to lift the polish rod. The inclined plane provided by the rotating screw is substantially less expensive to operate than a telescopic fluid driven cylinder. Unfortunately, in the event of a power loss, the descent of the travelling nut is so rapid that there is a risk of damage to the pumping unit. In the combination, the telescopic fluid cylinders serve as shock absorbers which slow the movement of the travelling nut. In the event of a power loss, the telescopic fluid cylinders slow the movement of the travelling nut sufficiently to avoid damage to the pumping unit.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
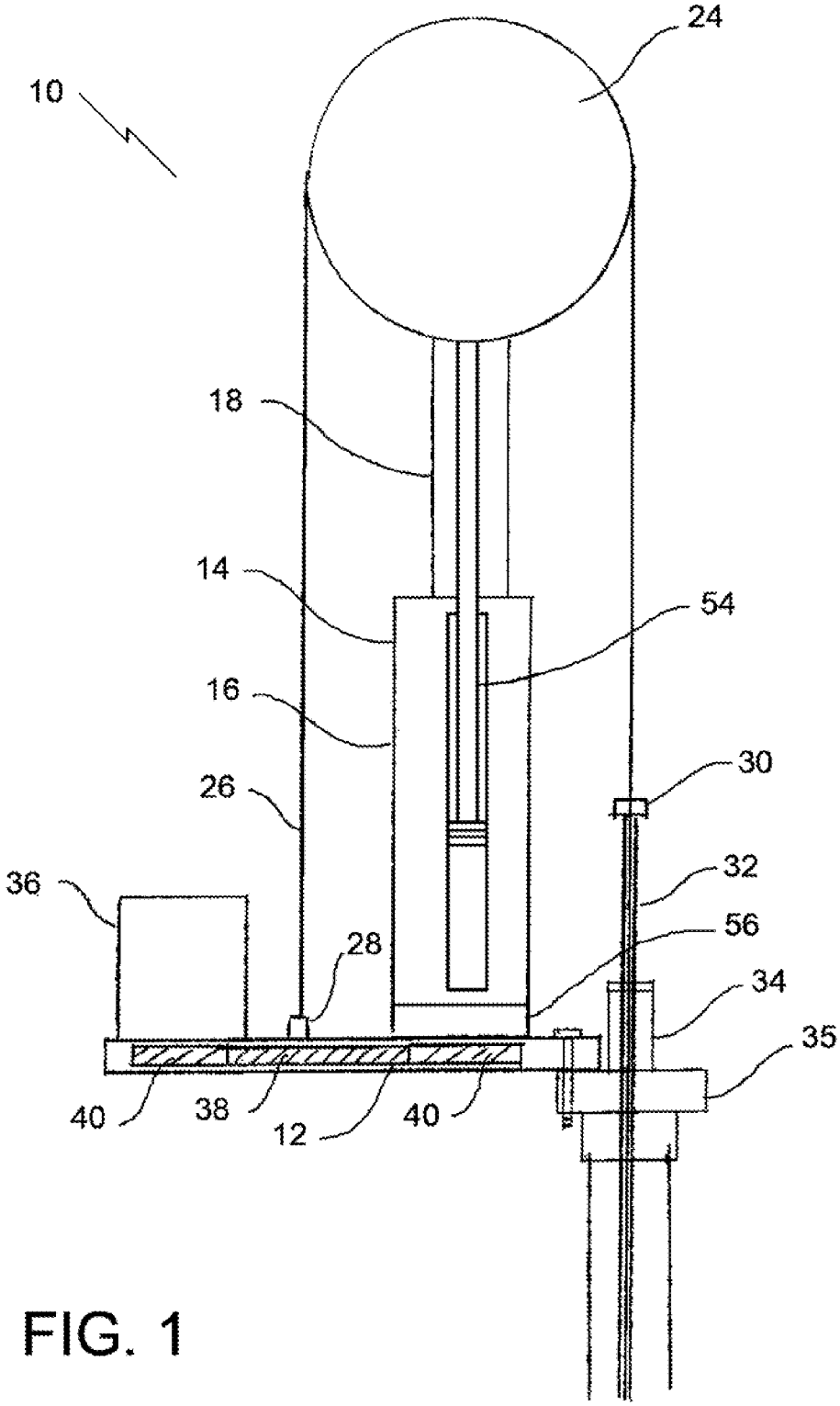
FIG. 1 is a side elevation view in partial section of drive assembly for a reciprocating pump constructed in accordance with the teachings of the present invention.

The preferred embodiment, a drive assembly for a reciprocating pump generally identified by reference numeral 10, will now be described with reference to FIGS. 1 through 4.

Figure 2:
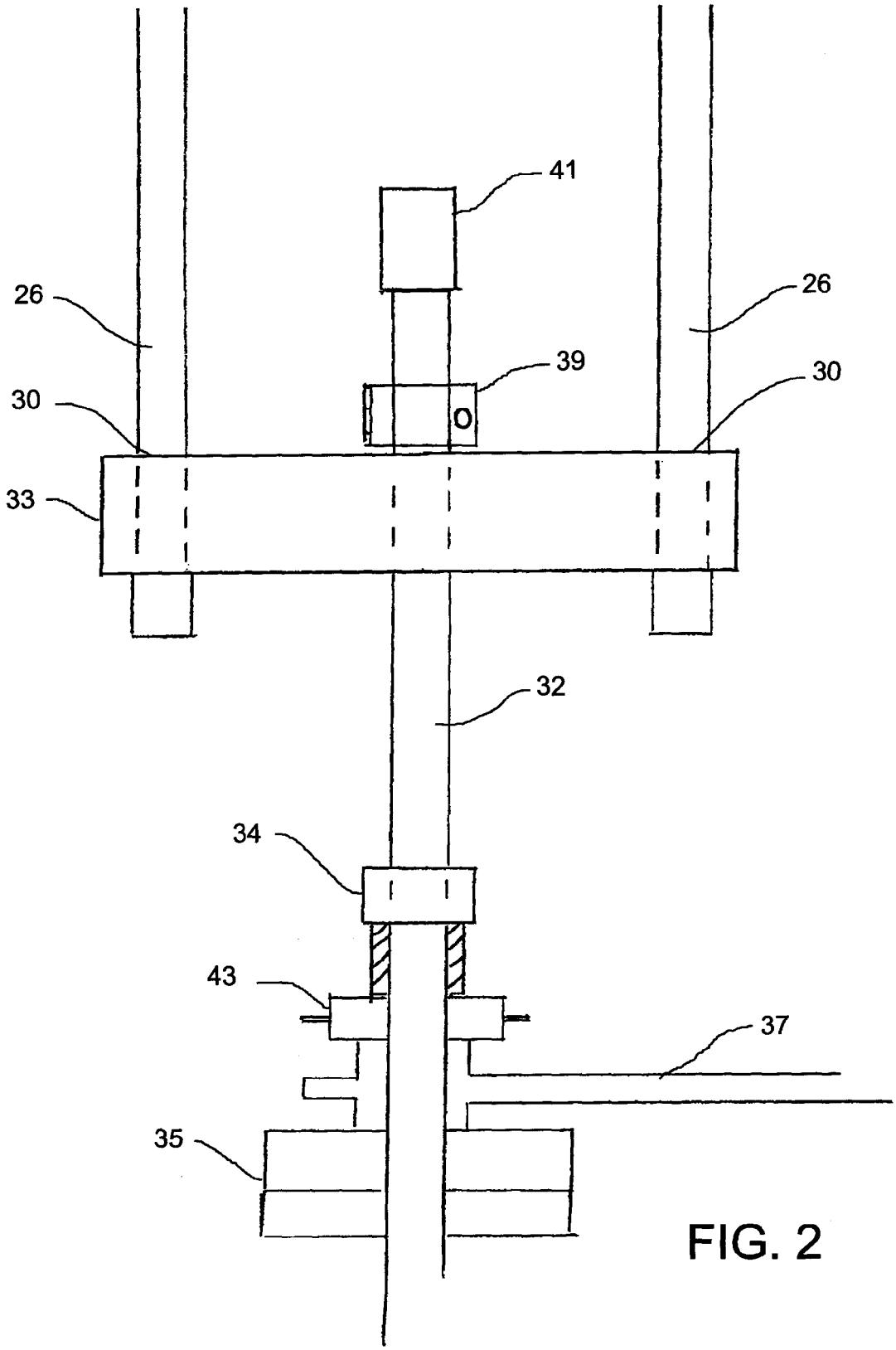
FIG. 2 is a detailed front elevation view, in section, of polish rod connection detail for the drive assembly for a reciprocating pump illustrated in FIG. 1.
Figure 3:
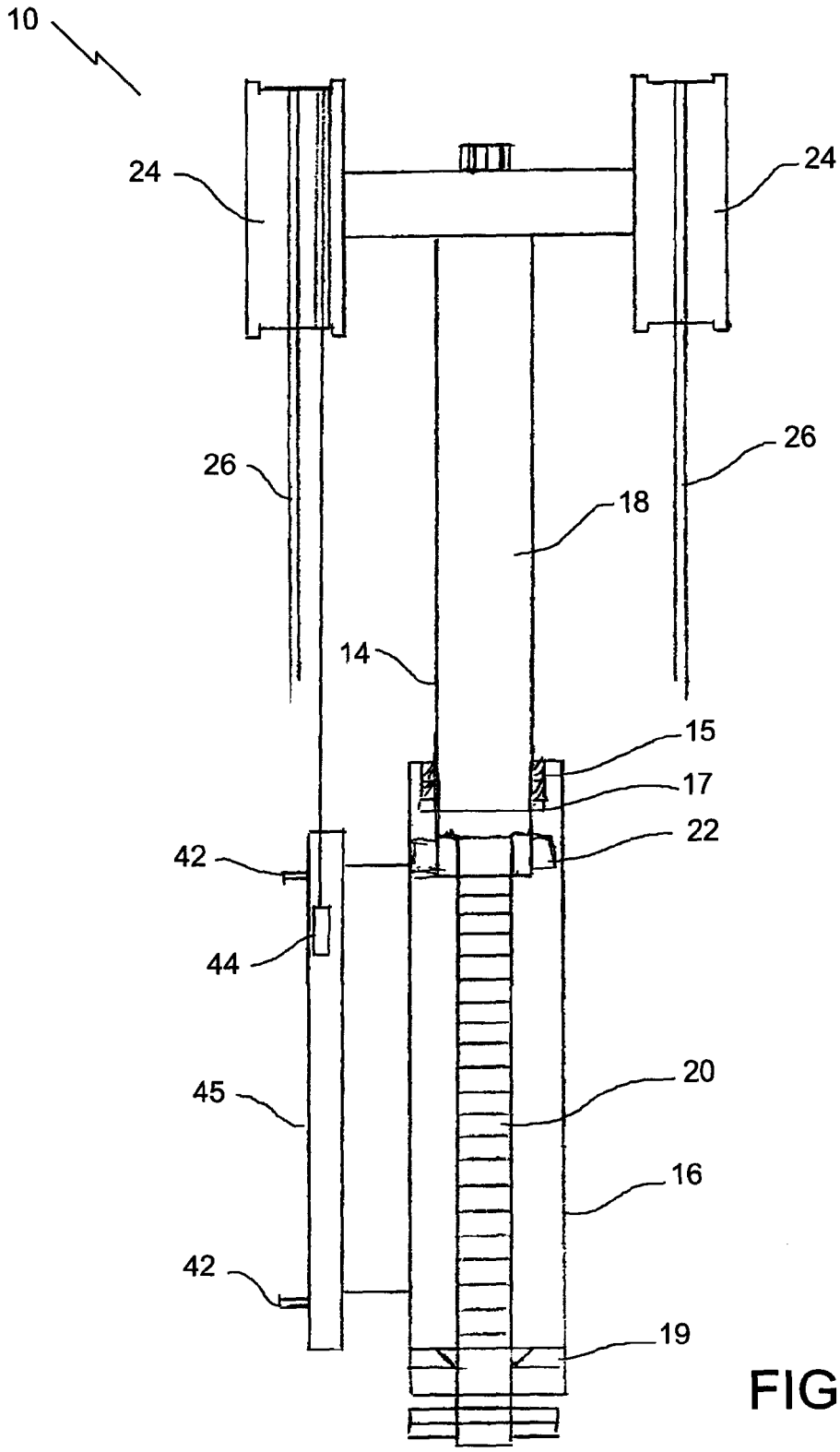
FIG. 3 is a first detailed front elevation view, in section, of a screw type linear actuator for the drive assembly for a reciprocating pump, with the movable ram portion in an extended position.

Structure and Relationship of Parts:

Referring to FIG. 1, drive assembly for a reciprocating pump 10 includes a support structure 12 and a linear actuator 14 mounted on the support structure 12. Linear actuator 14 has a stationary portion 16 and a movable ram portion 18. Referring to FIG. 3, linear actuator 14 is a screw 20 with a travelling nut 22 to which movable ram portion 18 is secured. Packing 15 with a brass support 17 for packing 15 is positioned at the top of stationary portion 16. At the bottom of stationary portion 16 are bearings 19 to allow screw 20 to rotate freely, and a brake 21 to stop screw 20 if necessary. Seals 23 are included to prevent leakage from bearings 19. Direction altering cable guides 24 are mounted to movable ram portion 18 of linear actuator 14. Referring to FIG. 1, cables 26 have a first end 28 and a second end 30. First end 28 is anchored to support structure 12, but could also be anchored to stationary portion 16 of linear actuator 14. Second end 30 is adapted to be attached to a polish rod 32 of a reciprocating pump (not shown) positioned downhole. Polish rod 32 passes through a stuffing box 34, and a wellhead 35. Between stuffing box 34 and wellhead 35 is a blow out preventer (BOP) valve 43, and a production line 37, where the fluids brought up from downhole are directed. Referring to FIG. 2, second ends 30 of cables 26 are shown to be connected to a carrier bar 33 by which is then connected to polish rod 32. Polish rod 32 includes a polish rod clamp 39, and may be coupled to other rods by coupling 41. Referring to FIG. 3, there are two cable guides 24 and cables 26, although the number of each may be altered according to the preference of the user. Referring again to FIG. 1, means for reciprocally moving movable ram portion 18 of linear actuator 14 are included, such as a reversible motor 36 which alternatively rotates screw 20 in a clockwise and a counter-clockwise direction to initiate movement of travelling nut 22. A brake 56 is used to stop or slow screw 20. As shown, reversible motor 36 includes a belt 38 connected to pulleys 40 to rotate screw 20. Referring to FIG. 3, linear actuator 14 is shown in the extended position with travelling nut 22 at the top of screw 20, while in FIG. 4, linear actuator 14 is shown in the retracted position, with travelling nut 22 at the bottom of screw 20. In this arrangement, as movable ram portion 18 moves, the cable 26 and cable guide 24 configuration provides a mechanical advantage which results in the polish rod 32 reciprocally moving a multiple of the distance traveled by movable ram portion 18 of linear actuator 14. Switches 42 with a switch activator 44 that moves with linear actuator 14 may be included to cause motor 36 to reverse direction when linear actuator 14 has reached the fully extended or fully retracted position, Switch activator travels in a guide, such as plastic pipe 45.

Operation:

The use and operation of drive assembly for a reciprocating pump 10 will now be discussed with reference to FIGS. 1 through 4. Drive assembly for a reciprocating pump 10 is arranged as described above. Starting in the retracted position shown in FIG. 4, travelling nut 22 is at the bottom of screw 20. Referring to FIG. 1, Reversible motor 36 causes screw 20 to rotate using pulleys 40 and belt 38. Referring to FIG. 3, this causes travelling nut 22 to move up screw 20 until it reaches the extended position as shown, with movable ram portion 18 and direction altering cable guides 24 also fully extended. Reversible motor is then reversed as top switch 42 is tripped by switch activator 44, and nut 22 returns to the bottom, with bottom switch 42 being tripped by activator 44. Referring again to FIG. 1, it can be seen that as cable guides 24 reach the top of the stroke, second end 30 which is attached to polish rod 32 as shown in FIG. 2 will travel twice as far, which in turn increases the stroke of polish rod 32 of pump. Brake 56 is used to slow or stop screw 20.

Figure 4:
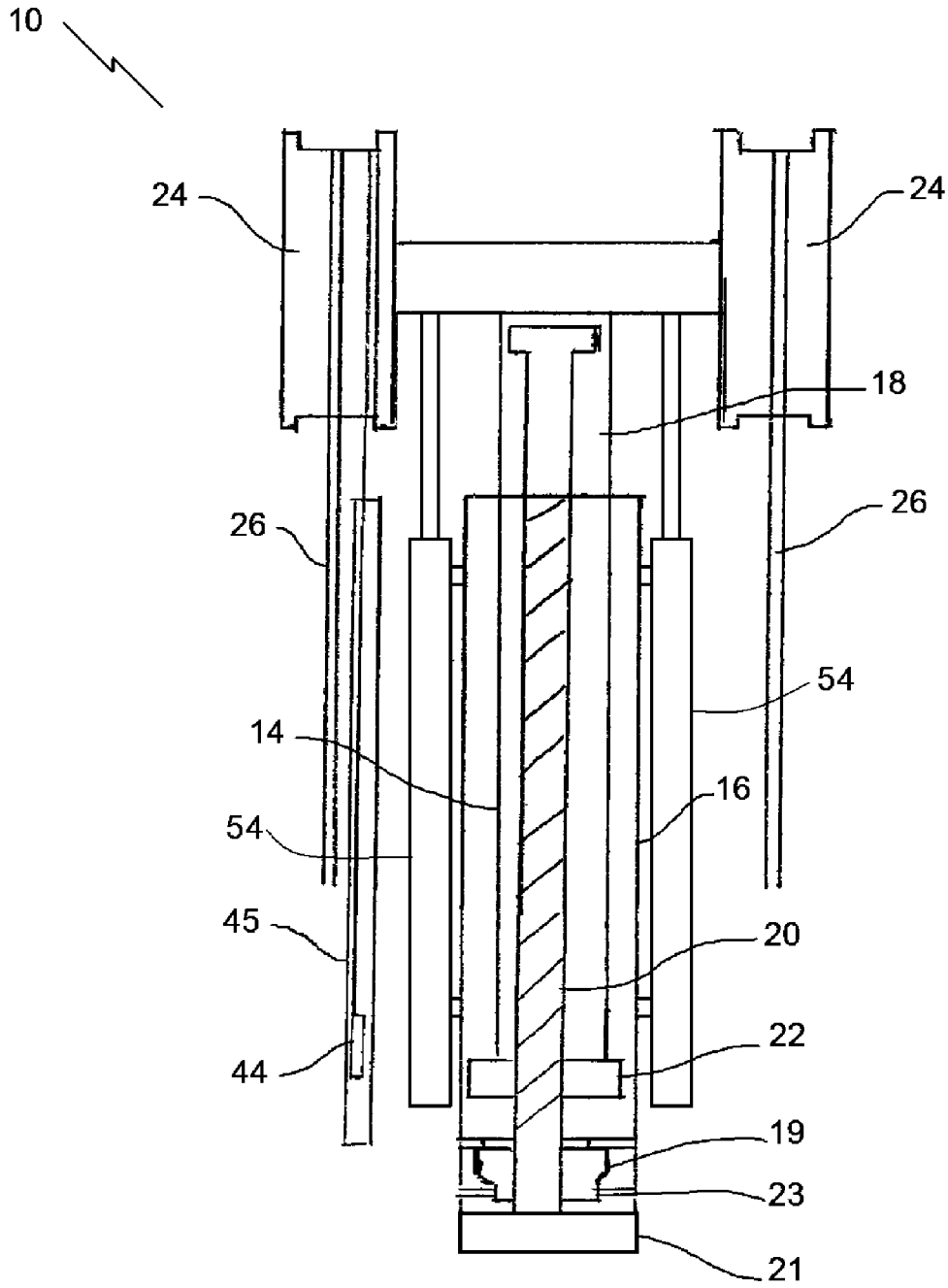
FIG. 4 is a second detailed front elevation view, in section, of a screw type linear actuator for the drive assembly for a reciprocating pump, with the movable ram portion in a retracted position.
Figure 5:
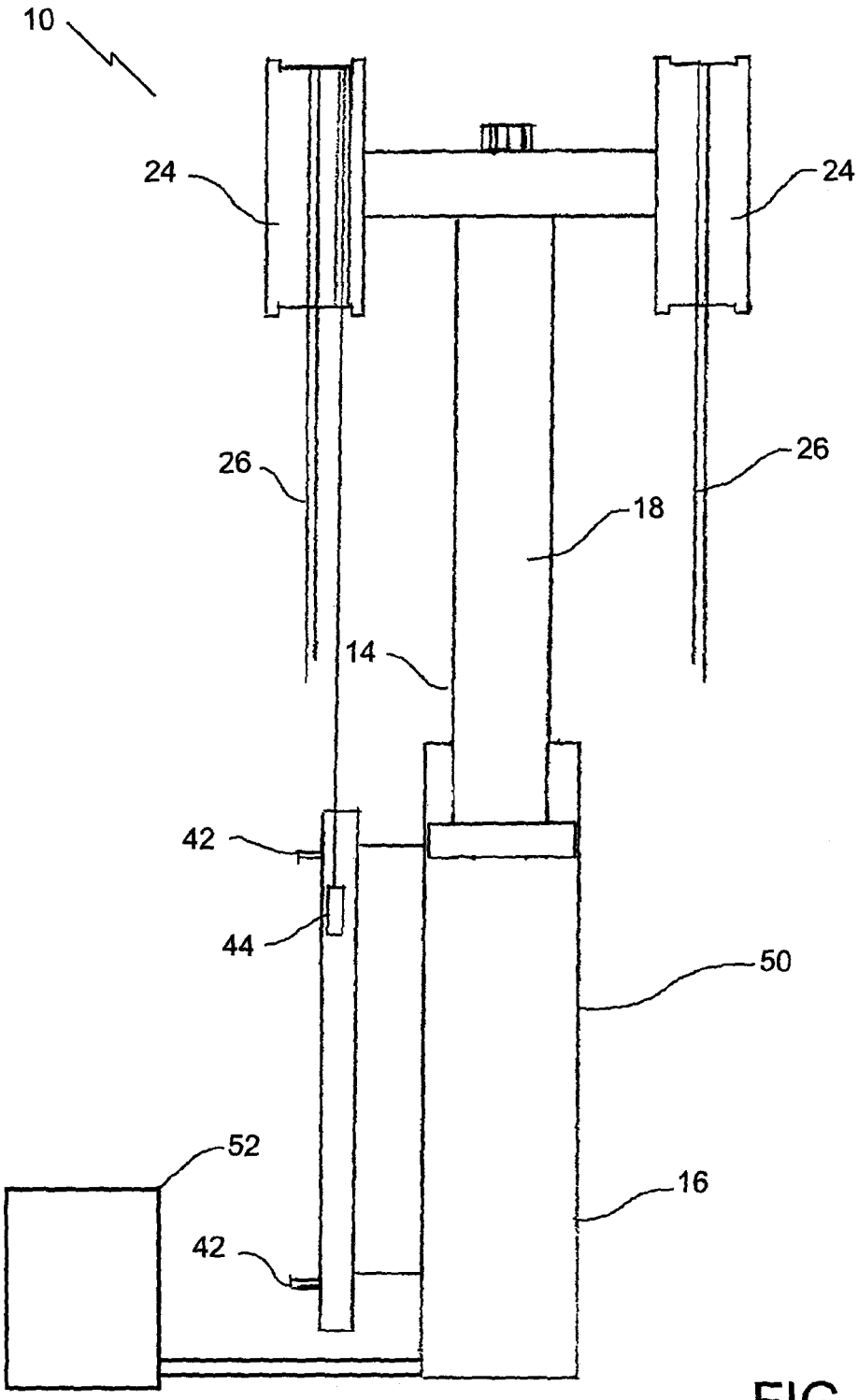
FIG. 5 is a first detailed front elevation view, in section, of a telescopic hydraulic cylinder type linear actuator for the drive assembly for a reciprocating pump, with the movable ram portion in an extended position.
Figure 6:
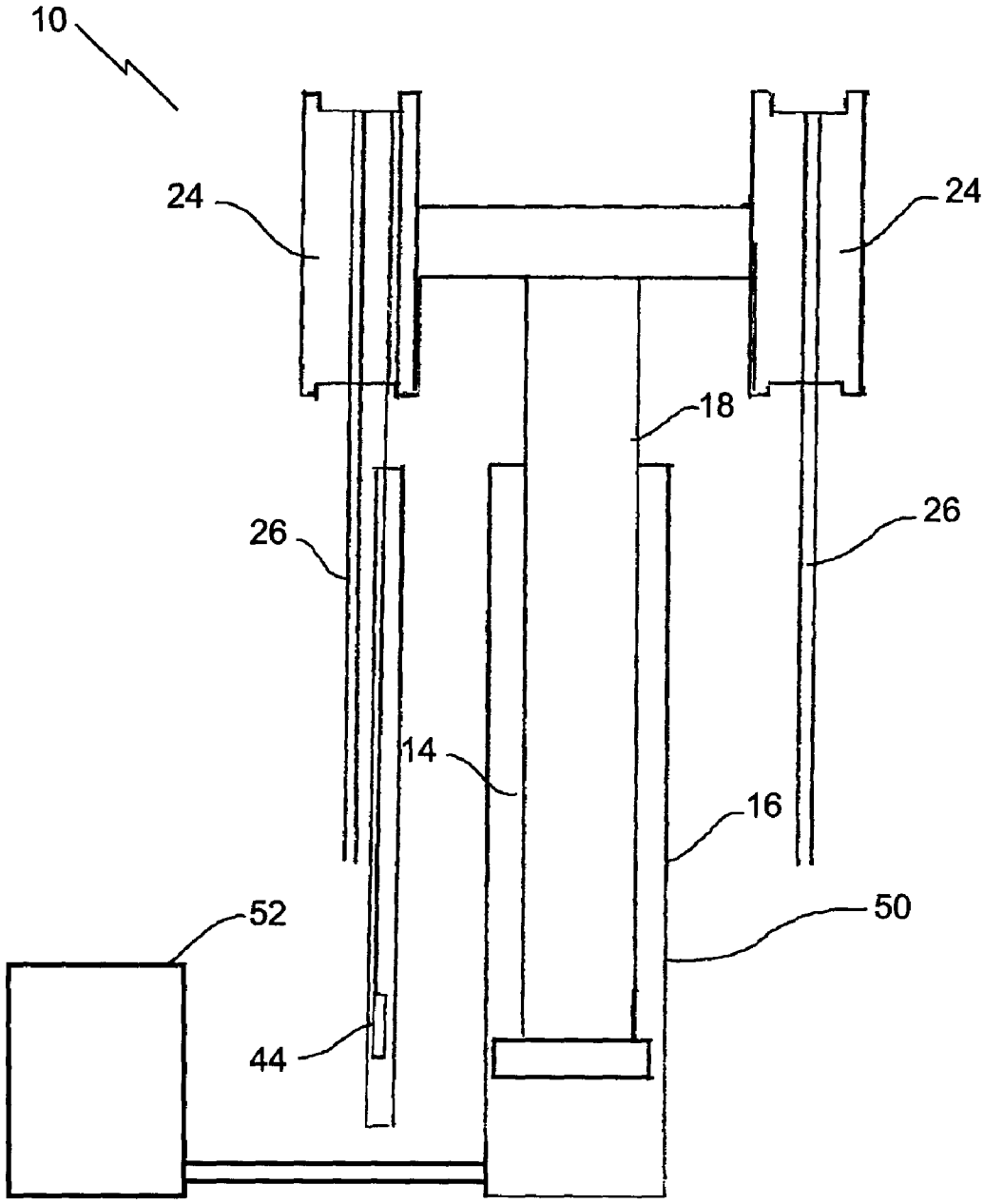
FIG. 6 is a second detailed front elevation view, in section, of a telescopic hydraulic cylinder linear actuator for the drive assembly for a reciprocating pump, with the movable ram portion in a retracted position.
Figure 7:
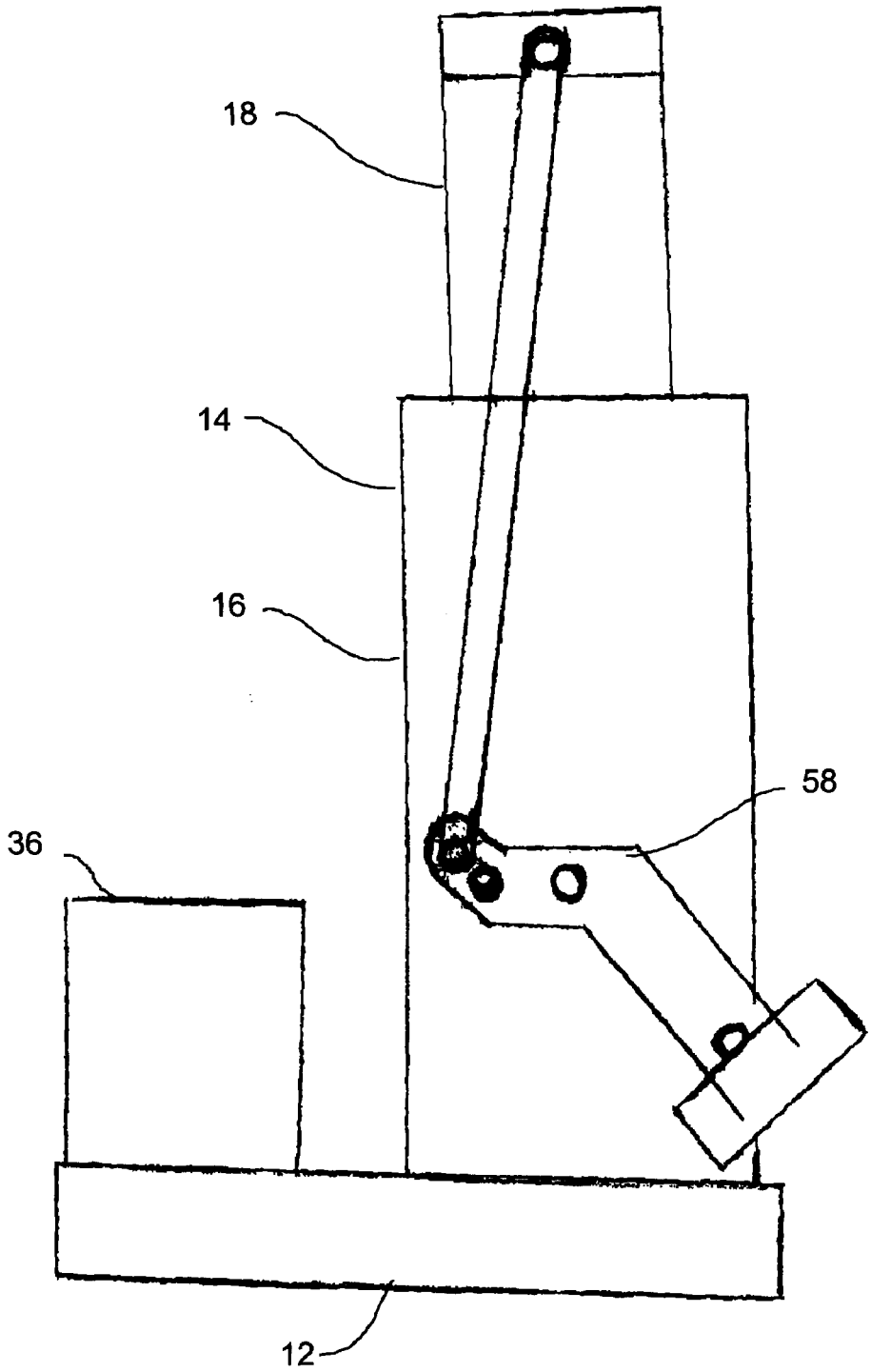
FIG. 7 is a detailed front elevation view of a screw type linear actuator using counter weights.

Variations:

Referring to FIGS. 5 and 6, linear actuator 14 may alternatively be a telescopic hydraulic cylinder 50, and the means for reciprocally moving movable ram portion 18 of linear actuator 14 is a hydraulic pump 52 which selectively supplies hydraulic fluid to telescopic hydraulic cylinder 50. Referring to FIGS. 1 and 4, hydraulic cylinders 54 may be used to support linear actuator 14 as shock absorbers. Cylinders 54 are adapted to slow the descent of movable ram portion 18 based on the weight of polish rod 32 in addition to actuator 14, and to help motor 36 raise movable portion 18 again. Referring to FIG. 7, a counterweight system 58 may be used to perform the same function as hydraulic cylinders 54 seen in FIGS. 1 and 4.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The embodiments of the invention in which an exclusive property or privilege is claimed are defined as follows:

1. A drive assembly for a reciprocating pump, comprising:

a support structure;

a linear actuator mounted on the support structure, the linear actuator having a stationary portion and a movable ram portion, the stationary portion of the linear actuator including a rotating screw with a travelling nut which carries the movable ram portion;

at least one direction altering cable guide mounted to the movable ram portion of the linear actuator;

at least one cable having a first end and a second end, the first end being anchored to one of the support structure or the stationary portion of the linear actuator, the second end being adapted for attachment to a polish rod of a reciprocating pump;

a reversible motor which alternatively rotates the screw in a clockwise and a counter-clockwise direction to initiate movement of the travelling nut which carries the movable ram portion, such that the movable ram portion moves the cable and cable guide which results in the polish rod reciprocally moving a multiple of the distance travelled by the moveable ram portion of the linear actuator; and a pair of fluid cylinders positioned on opposed sides of the rotating screw, the fluid cylinders acting as shock absorbers to slow the descent of the travelling nut which carries the moveable ram portion and, in particular, the otherwise uncontrolled descent of the travelling nut which occurs in the event of a power failure.

2. The drive assembly as defined in claim 1, wherein a brake is provided which is adapted to stop rotation of the screw.

* * * * *